US005743126A

United States Patent [19]

Shore et al.

[11] Patent Number: 5,743,126

[45] Date of Patent: Apr. 28, 1998

[54] ROLL STAND WITH SEPARABLE ROLL PARTING ADJUSTMENT MODULE

[75] Inventors: Terence M. Shore, Princeton; Harold E. Woodrow, Northboro, both of Mass.; Yoshio Kato, Chita-gun, Japan

[73] Assignee: Morgan Construction Company, Worcester, Mass.

[21] Appl. No.: 498,630

[22] Filed: Jul. 6, 1995

[51] Int. Cl.[6] ..... B21B 31/26

[52] U.S. Cl. ..... 72/237; 72/248

[58] Field of Search ..... 72/237, 238, 239, 72/248

[56] References Cited

U.S. PATENT DOCUMENTS

| | | | |
|---|---|---|---|
| 3,945,234 | 3/1976 | Steinbock | 72/238 |
| 4,969,347 | 11/1990 | Matsuo et al. | 72/247 |
| 5,127,251 | 7/1992 | Casagrande et al. | 72/248 |

FOREIGN PATENT DOCUMENTS

| | | | |
|---|---|---|---|
| 0163104 | 12/1985 | European Pat. Off. . | |
| 0328645 | 8/1989 | European Pat. Off. . | |
| 2190535 | 2/1974 | France . | |
| 2555446 | 6/1977 | Germany . | |
| 148732 | 6/1981 | Germany | 72/248 |
| 57-50565 | 12/1982 | Japan | 72/248 |

*Primary Examiner*—Lowell A. Larson
*Assistant Examiner*—Thomas C. Schoeffler
*Attorney, Agent, or Firm*—Samuels, Gauthier, Stevens & Reppert

[57] ABSTRACT

A roll stand for a rolling mill has a housing with a through opening. The housing rotatably supports a pair of roll shafts, at least one of which is journalled for rotation in the eccentric bores of interconnected sleeves. The roll shafts carry work rolls positioned in the through opening to define a roll pass therebetween. An adjustment mechanism is axially engageable with one of the interconnected sleeves to rotate both sleeves and thereby adjust the parting between the work rolls. The adjustment mechanism is contained in a module which is separably connected to the housing.

13 Claims, 6 Drawing Sheets

ROLL STAND WITH SEPARABLE ROLL PARTING ADJUSTMENT MODULE

BACKGROUND OF THE INVENTION

1. Field of the Invention

This invention relates generally to rolling mills for continuously hot rolling single strand products such as bars, rods and the like in a twist-free manner, and is concerned in particular with an improvement in the design of the roll stands used to "size" such products at the delivery end of the mill.

2. Description of the Prior Art

As herein employed, the terms "size" and "sizing" refer to the finish rolling of rod and bar products to extremely close tolerances approaching cold drawn tolerances by taking a succession of relatively light reductions on the order of about 1–18% per stand.

With reference initially to FIGS. 1–3, in the conventional sizing operation, a product "P" with a round cross section as shown in FIG. 2A is rolled through a succession of three successive roll stands 10, 12, and 14 having the axes of their respective work pairs 10*a*,10*a*; 12*a*,12*a*; and 14*a*,14*a* offset by 90° in order to achieve twist-free rolling.

The work rolls are carried on roll shafts 16 which are journalled for rotation in the eccentric bores of sleeves 18, the latter in turn being journalled for rotation in the housings of the respective roll stands. The eccentric sleeves are provided with externally geared peripheries 19 which are engaged by laterally disposed worms 20 carried on adjustment shafts 22. Rotation of the adjustment shafts imparts opposite hand rotation to the eccentric sleeves of the roll shafts of respective roll pairs, thereby achieving symmetrical roll parting adjustments in a manner well known to those skilled in the art.

The work rolls 10*a* of the first stand 10 effect a slight reduction on the order of 4 to 18% while imparting a horizontally oriented ovalness to the product as depicted in FIG. 2B. At the next roll pass defined by work rolls 12*a*, a further reduced but vertically oriented ovalness is achieved, as depicted in FIG. 2C. The oval shapes depicted in FIGS. 2B and 2C have been exaggerated for purposes of illustration. In practice, roll stands 10 and 12 effect very slight changes in cross-sectional shape, with the exiting products being only slightly oval in shape. At the last roll stand defined by work rolls 14*a*, the product is further reduced to achieve a precision round as depicted in FIG. 2D.

Conventional roller guides are largely ineffective in controlling the orientation of the slightly oval cross sections emerging from roll stands 10 and 12. Thus, it becomes essential to reduce interstand spacing as much as possible in order to limit any opportunity for the product to twist as it passes from one stand to the next. The spacing between stands 10 and 12 is kept to a minimum by locating the eccentric sleeve adjusting mechanisms (the adjusting shafts 22 and worms 20) of stand 10 before the work rolls 10*a*, while locating the eccentric sleeve adjusting mechanisms of stand 12 after the work rolls 12*a*. In this manner, the spacing $S_1$ between the work roll pairs of the first two stands 10, 12 can be held to something approaching the diameter of the work rolls.

However, with the conventional design, it is not possible to achieve a comparable reduction in spacing between the work roll pairs of stands 12 and 14 due to the unavoidable interposition of the eccentric sleeve adjusting mechanisms of stand 12 therebetween. Thus, the spacing $S_2$ between work roll pairs of stands 12 and 14 is increased considerably as compared to the spacing $S_1$, making it difficult to control the attitude of the product entering the final roll stand 14.

In the conventional rolling operation, the mill operator will additionally require spare roll stands (not shown) which can be serviced off-line and rapidly exchanged for those being removed from the rolling line as part of normal mill maintenance. This represents a significant capital investment, particularly in view of the fact that each conventional roll stand includes its own dedicated eccentric sleeve adjustment mechanisms.

An object of the present invention is to provide an improved eccentric sleeve adjusting mechanism which is positioned to accommodate extremely close spacing between all of the roll stands of a sizing train.

A further objective of the present invention is to detachably couple the eccentric sleeve adjusting mechanism to the remainder of the roll stand components, thereby making it possible to employ the same eccentric sleeve adjusting mechanism with other similarly configured roll stands.

SUMMARY OF THE INVENTION

In a preferred embodiment of the invention to be hereinafter described in greater detail, the eccentric sleeves on one side of the roll pass are rotatably coupled to the eccentric sleeves on the opposite side of the roll pass. The eccentric sleeve adjusting mechanism is contained within a module detachably connected to the roll stand housing and is positioned to axially engage the eccentric sleeves on only one side of the roll pass. The eccentric sleeve adjusting mechanisms are thus completely removed from positions between the successive stands where they would otherwise interfere with close interstand spacing. The containment of the eccentric sleeve adjusting mechanisms in detachable modules is also advantageous in that it obviates the expense of providing each roll stand with a dedicated adjustment mechanism.

These, and other features and attendant advantages of the present invention will become more apparent as the description proceeds with the aid of the accompanying drawings, wherein:

BRIEF DESCRIPTION OF THE DRAWINGS

FIG. 7 is a partial front view of the horizontal roll stand shown in FIG. 5, with portions broken away and with the module containing the eccentric sleeve adjusting mechanism removed there from;

DETAILED DESCRIPTION OF THE ILLUSTRATED EMBODIMENTS

Figure 1:
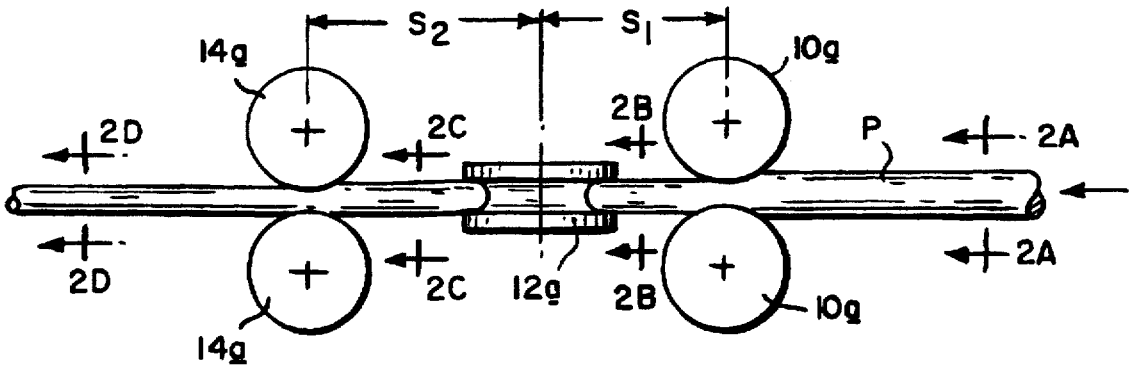
FIG. 1 PRIOR ART
FIG. 1 is a diagrammatic depiction of a succession of roll passes in a conventional sizing train.
Figures 2A, 2B, 2C, 2D:
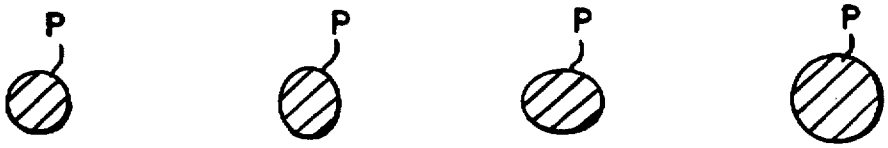
FIGS. 2A–2D are sectional views on an enlarged scale taken along lines 2A—2A, 2B—2B, 2C—2C and 2D—2D of FIG. 1, showing the successive reductions in cross-sectional area, with oval shapes exaggerated for purposes of illustration.
Figure 3:
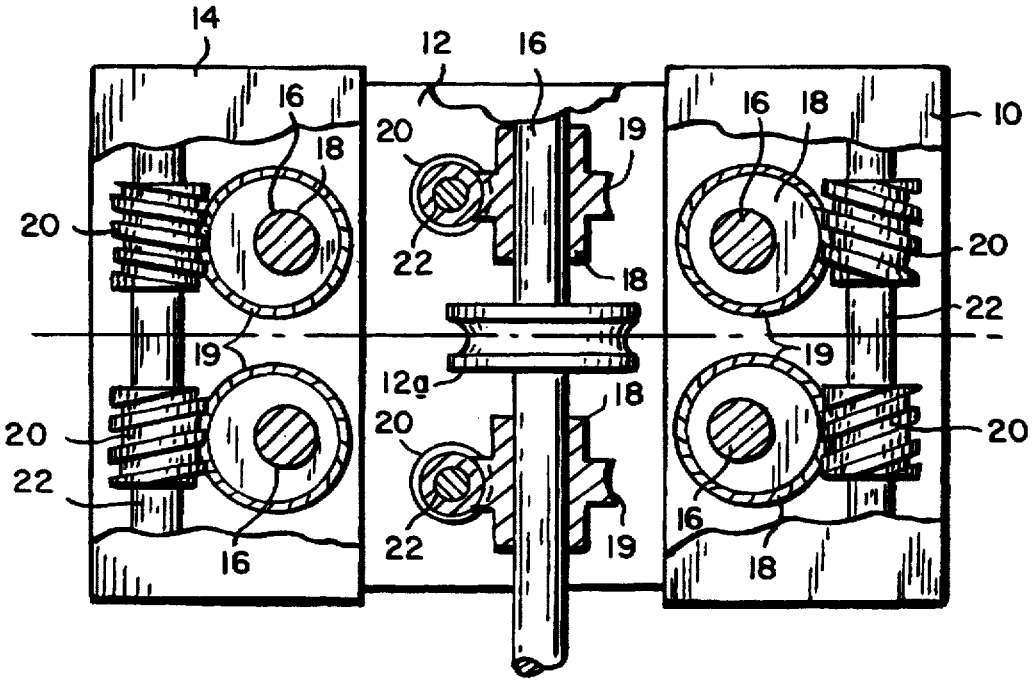
FIG. 3 PRIOR ART
FIG. 3 is a further diagrammatic illustration of the sizing train shown in FIG. 1.
Figure 4:
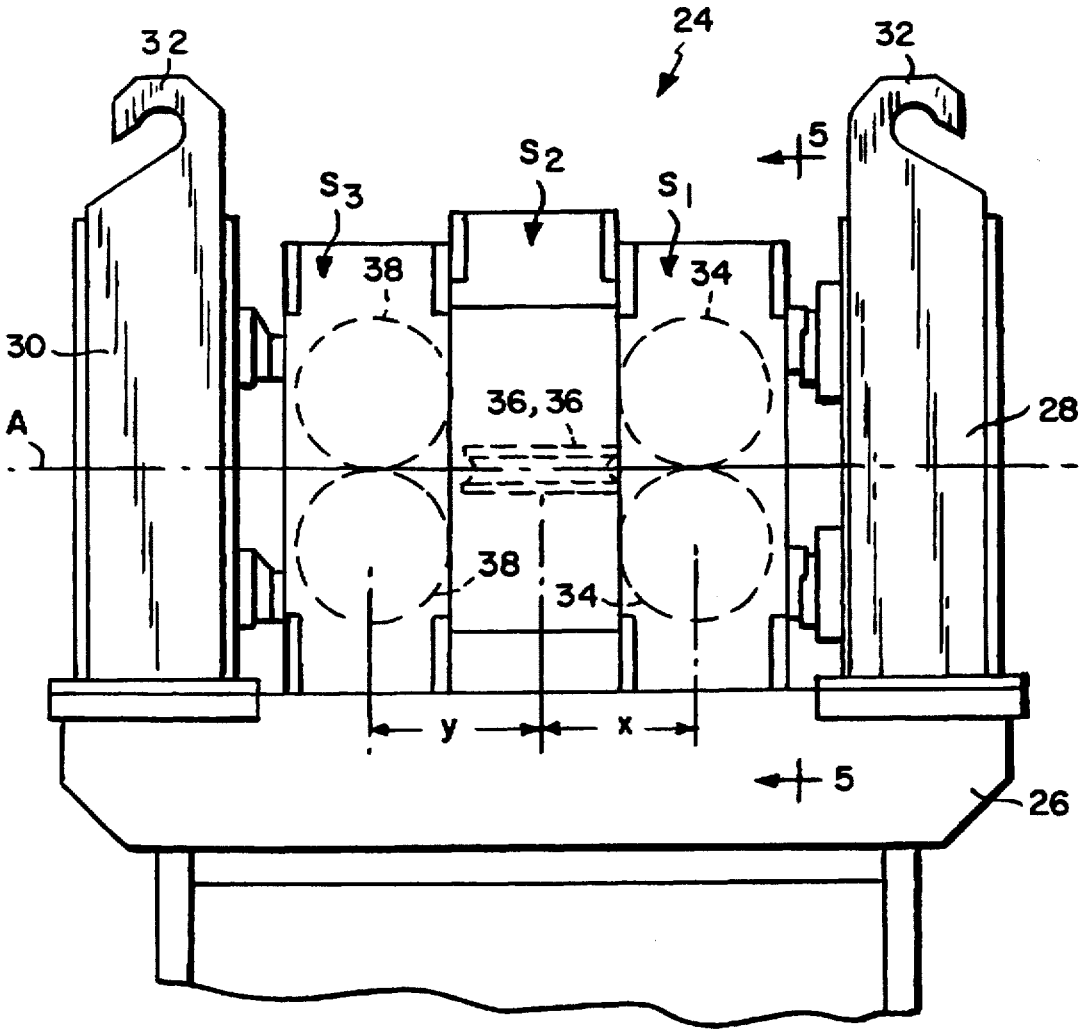
FIG. 4 is a view in side elevation of a three-stand sizing train in accordance with the present invention.

Referring initially to FIG. 4, a sizing train according to the present invention is generally depicted at 24. The sizing train is mounted on a portable cradle having a base 26 and end stanchions 28, 30 with hooks 32 which may be engaged by the lift cables of an overhead crane (not shown) when transporting the unit to and from the rolling line. The sizing train 24 includes three roll stands $S_1$, $S_2$ and $S_3$ provided respectively with work roll pairs 34,34; 36,36; and 38,38. The work pairs 34,34 and 38,38 are horizontally disposed, whereas the work roll pair 36,36 is vertically disposed to thereby accommodate twist-free rolling of a product directed from left to right along the mill pass line "A".

The roll stands $S_1$, $S_2$ and $S_3$ have essentially identical internal configurations, and hence an understanding of each can be had by reference to FIGS. 5–14 which provide various views of roll stand $S_1$.

Figure 6:
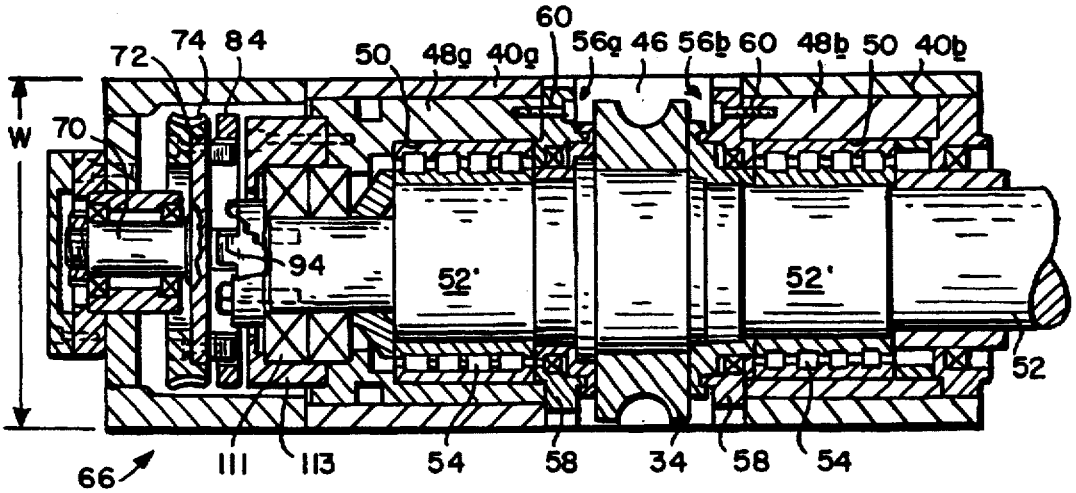
FIG. 6 is a horizontal sectional view taken along line 6—6 of FIG. 5.
Figure 8:
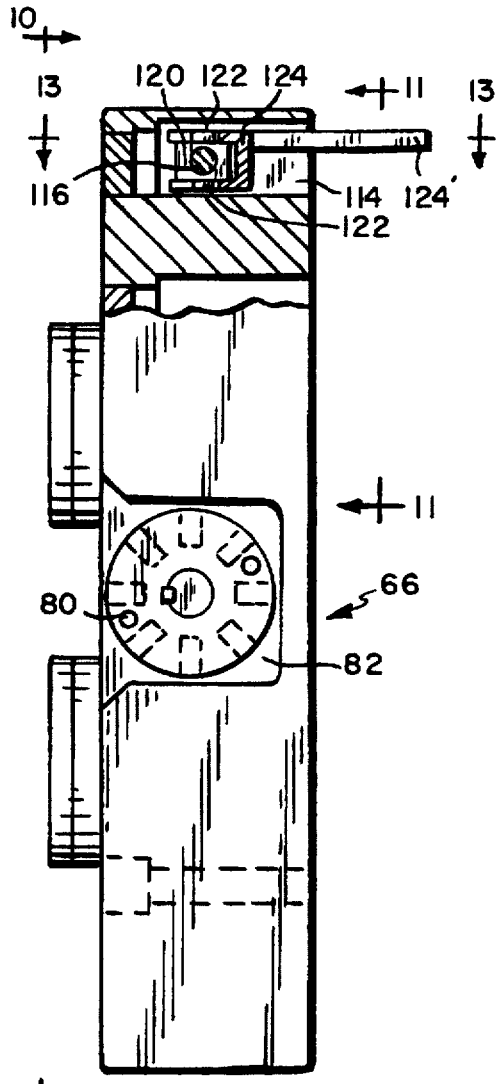
FIG. 8 is a front view of the module containing the eccentric sleeve adjustment mechanism removed from the roll stand.
Figure 7:
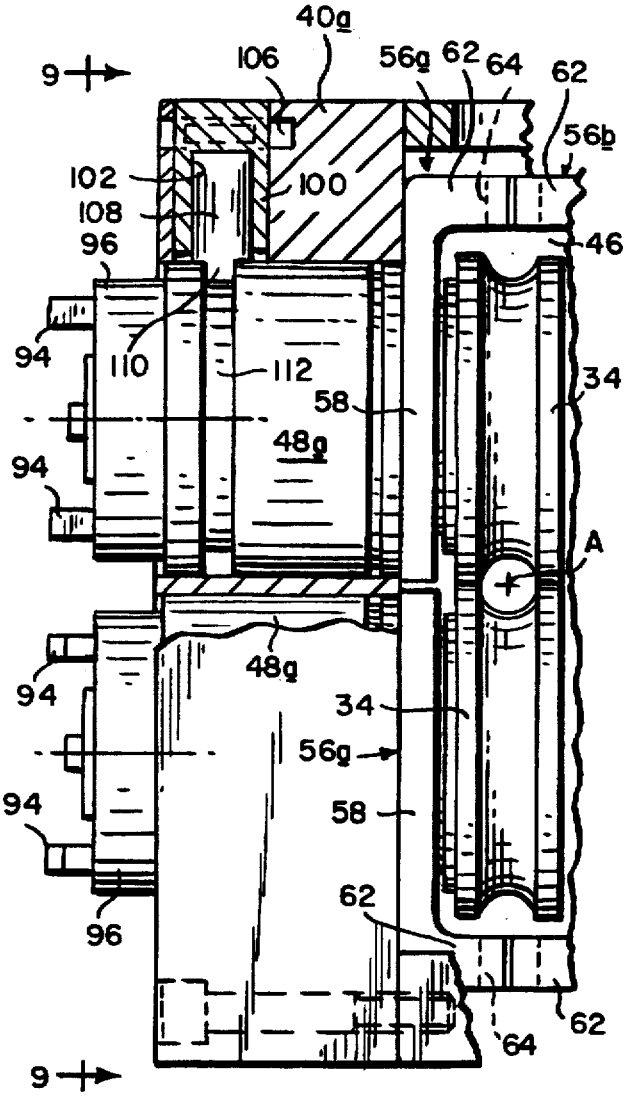
Figure 11:
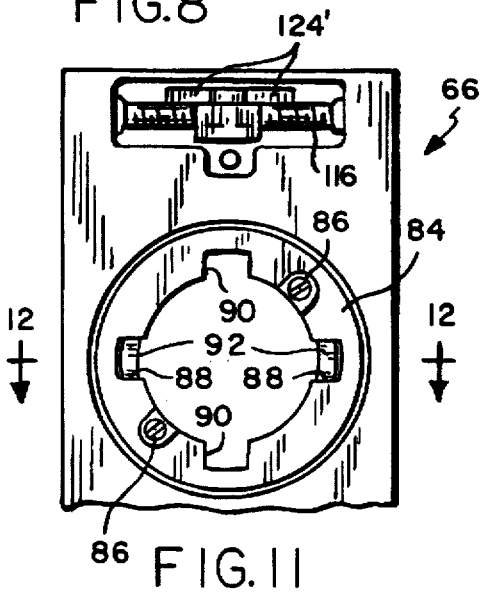
FIG. 11 is a partial end view taken along line 11—11 of FIG. 8.
Figure 12:
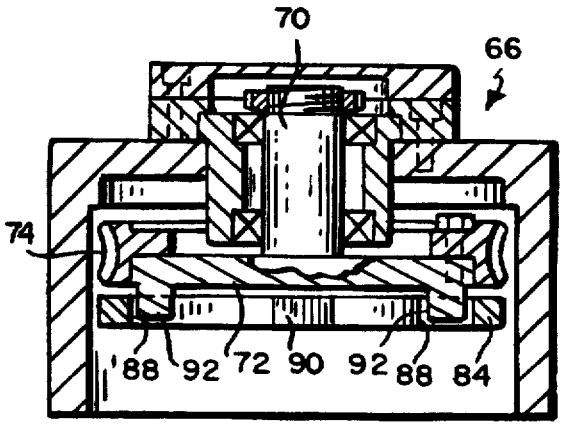
FIG. 12 is a sectional view taken along line 12—12 of FIG. 11.
Figure 9:
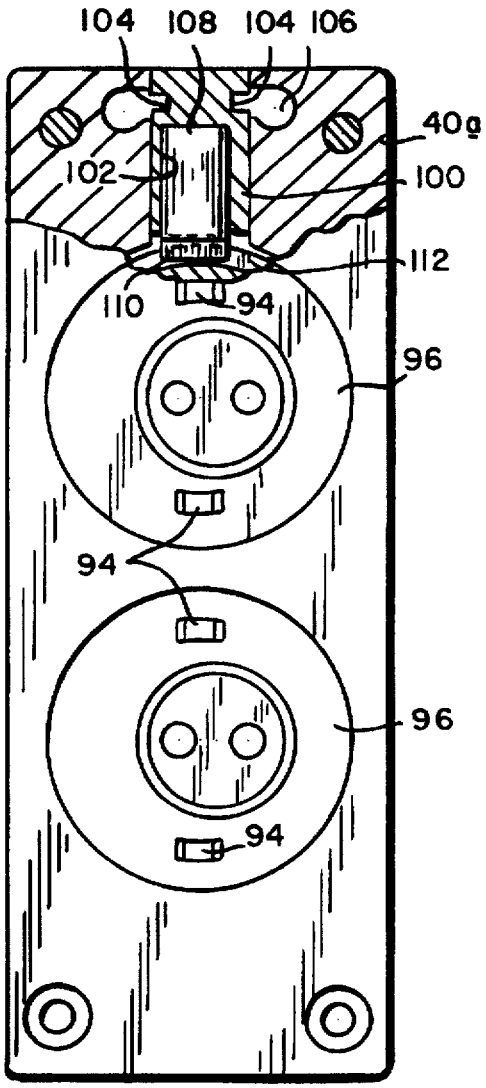
FIG. 9 is an end view of the roll stand, taken along line 9—9 of FIG. 7, with portions broken away.
Figure 10:
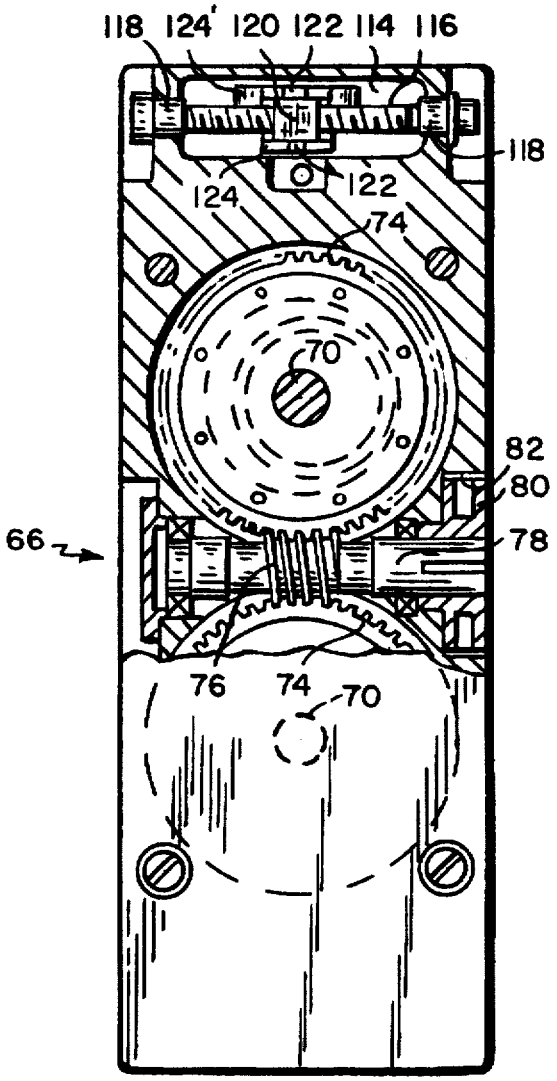
FIG. 10 is an end view of the module containing the eccentric sleeve adjustment mechanisms taken along line 10—10 of FIG. 8, with portions broken away.

Roll stand $S_1$ includes a housing made up of side members 40*a*, 40*b* spaced apart by and joined to top and bottom intermediate filler pieces 42, 44 to thereby define a through opening 46. Two sets of axially aligned first and second sleeves 48*a*, 48*b* are journalled in the housing side members 40*a*, 40*b* for rotation about parallel axes. The first and second sleeves 48*a* and 48*b* of each set are located on opposite sides of the through opening 46 and as is best seen in FIG. 6, have axially aligned eccentric bores 50. A pair of roll shafts 52 extends across the through opening 46 and protrudes from one side of the housing for coupling to a mill drive (not shown). Neck portions 52' of the roll shafts are journalled for rotation in the eccentric sleeve bores 50 by means of roller bearings 54. The work rolls 34 are located in the through opening 46 and are carried on the roll shafts 52 between the eccentric sleeves 48*a*, 48*b* journalled in the housing side members 40*a*, 40*b*. The work rolls are grooved to define a roll pass aligned with the mill pass line A.

Yoke assemblies 56*a*,56*b* are interposed between the work rolls 34 and the first and second eccentric sleeves 48*a*,48*b* of each set. The yoke assemblies each include collars 58 which surround the rolls shafts 52, and which are connected as at 60 to the inner ends of the respective eccentric sleeves 48*a*,48*b*. The collars 58 have confronting integral bridging segments 62 with juxtaposed ends located laterally of the work rolls 34 and interconnected by any convenient means, for example keys 64. The yoke assemblies thus serve as couplings which rotatably interconnect the eccentric sleeves 48*a*,48*b* of each set.

Figure 14:
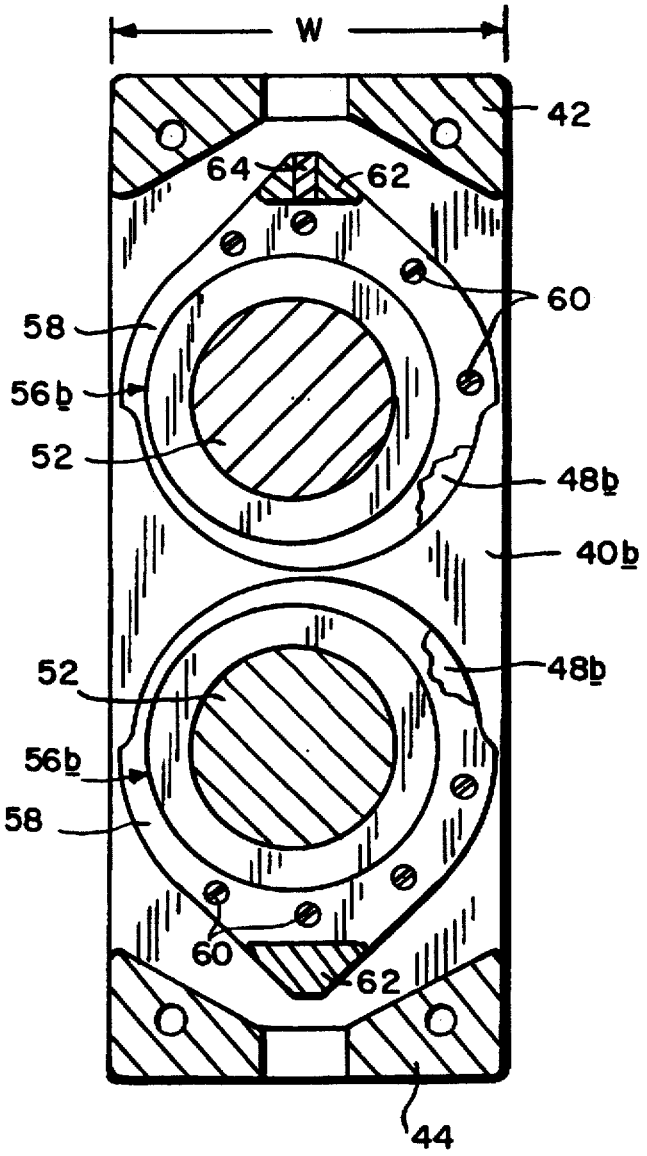
FIG. 14 is a sectional view taken along line 14—14 of FIG. 5.

As best can be seen by a comparison of FIGS. 6 and 14, the yoke assemblies lie substantially within the plane of the eccentric sleeves and thus do not contribute to an increase in the width "w" of the housing as measured in the direction of the mill pass line A.

An eccentric sleeve adjustment module 66 is detachably connected to the housing side member 40*a* by any convenient means, for example bolts 68. The module 66 rotatably supports a pair of gear shafts 70 journalled for rotation about parallel axes. The gear shafts 70 have gear plates 72 to which are secured worm gears 74. As can best be seen in FIG. 10, the worm gears 74 in turn are in meshed relationship with a common worm 76 carried on a spindle shaft 78. The spindle shaft has an adjustment wheel 80 secured to it at one end. The adjustment wheel is accessible via a notched recess 82 in the module side, and has peripherally arranged radial recesses which may be engaged by a tool (not shown) to rotate the spindle shaft and thereby impart simultaneous opposite hand rotation to the worm gears 74.

Figure 5:
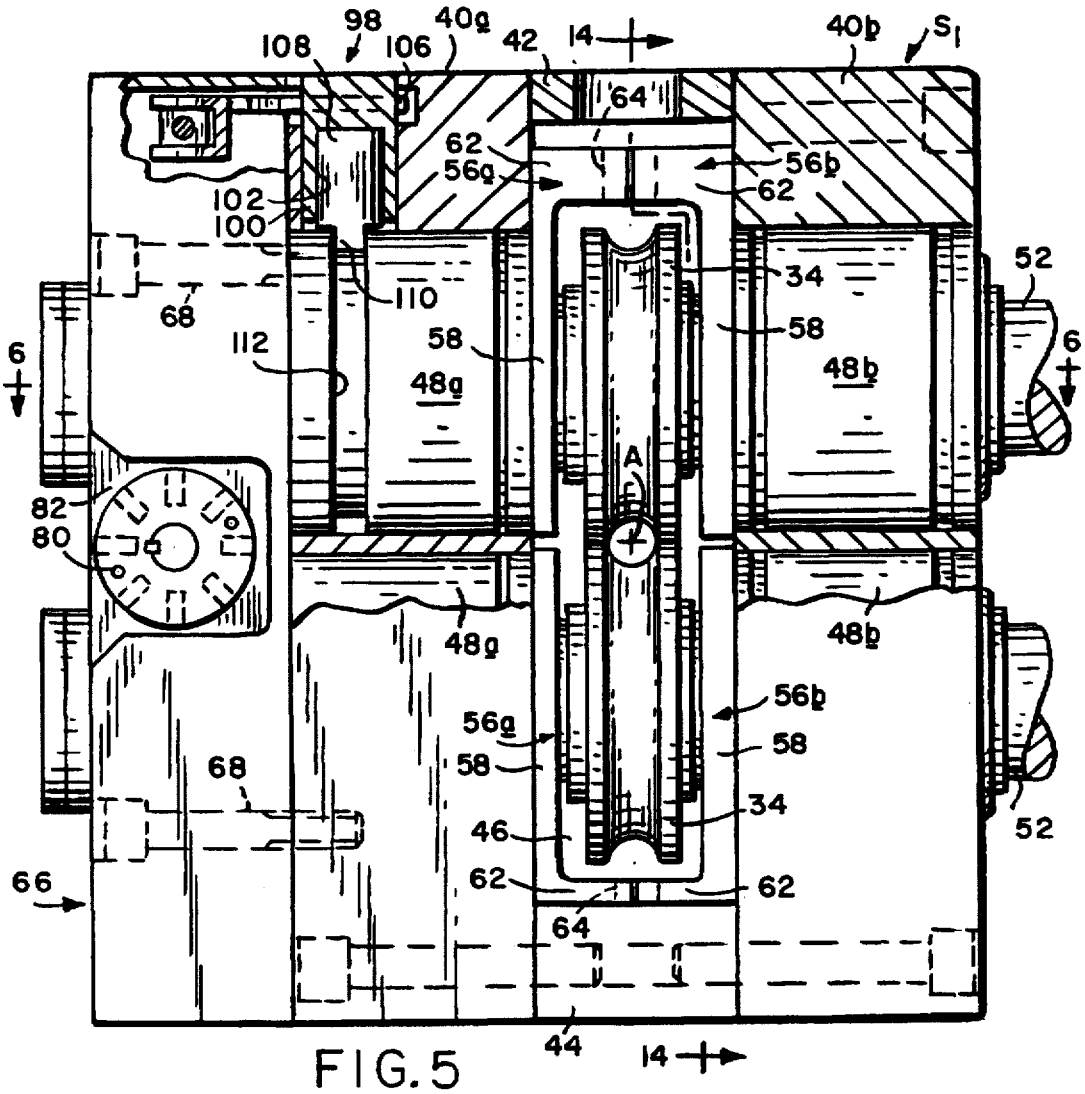
FIG. 5 is a front view of the first horizontal roll stand, on an enlarged scale and with portions broken away, taken along line 5—5 of FIG. 4.

Each worm gear 74 is axially engageable with and separably connected to one end of a respective eccentric sleeve 48*a* by means of a so-called "Oldham coupling" arrangement. More particularly, as can best be seen by reference to FIGS. 6, 9, 11 and 12, a driving ring 84 is loosely connected in a "floating" relationship to the gear plate 72 by means of shoulder screws 86. The driving ring has two sets of peripheral notches 88, 90. Notches 88 receive and coact in mechanical interengagement with lugs 92 protruding from the gear plate 72. When the module 66 is secured to the housing side member 40*a*, the notches 90 receive and similarly coact in mechanical interengagement with lugs 94 protruding in the opposite direction from collars 96 rotatably fixed in relation to and extending axially from the adjacent ends of the respective eccentric sleeves 48*a*. Thus, when the module 66 is connected to the side members 40*a* of the roll stand housing as depicted in FIGS. 5 and 6, rotation of the adjustment wheel 80 will operate via worm 76, worm gears 74 and the above described Oldham coupling arrangement to impart simultaneous opposite hand rotation to the eccentric sleeves 48*a*, which rotation will be transmitted via the keyed yoke assemblies 56*a*,56*b* to the mating eccentric sleeves 48*b* of each set, thereby imparting symmetrical roll parting adjustments to the work rolls 34. Detachment of the module 66 from the housing side wall 40*a* automatically decouples the driving ring 84 from the lugs 94.

At least one eccentric sleeve (in this case, the sleeve 48*a* of the upper set) and its respective roll shaft and work roll is shiftable axially with respect to the other shaft and work roll by means of an axial adjustment mechanism generally indicated at 98 in FIG. 5. This mechanism includes a collar 100 journalled for rotation in the housing side member 40*a*. Collar 100 has an eccentric bore 102 and external oppositely disposed flat-bottomed notches 104 (see FIG. 9) aligned with a slot 106 in the housing side member. A pin 108 is journalled for rotation in the eccentric bore 102 of the collar 100. Pin 108 has a flat spade-like end projection 110 extending into an external groove 112 in the adjacent eccentric sleeve 48*a*.

Figure 13:
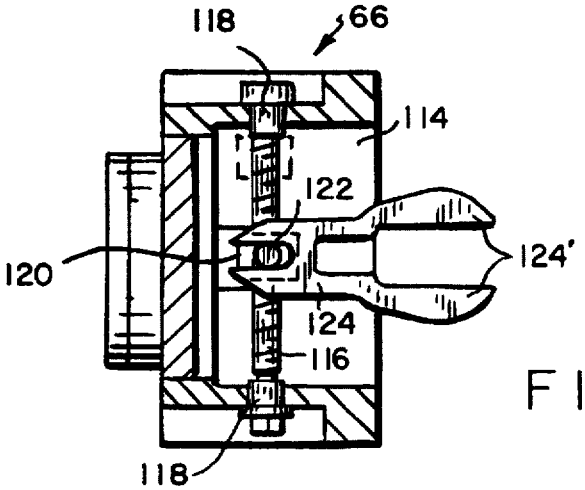
FIG. 13 is a sectional view taken along line 13—13 of FIG. 8.

Referring additionally to FIG. 13, it will be seen that the module 66 includes an upper open-sided recess 114 across which extends a threaded spindle 116 journalled between bearings 118. The spindle 116 carries a nut element 120 pivotally connected by integral oppositely protruding pins 122 to the base of a bifurcated element 124, the branches 124' of which are designed to enter the slot 106 in housing side member 40*a* and to straddle the notches 104 in collar 100. When thusly coupled as a result of attachment of the module 66 to the housing side member 40*a*, rotation of the spindle 116 will act through the nut 120 and the bifurcated element 124 to rotate the collar 100. By virtue of the eccentric bore 102 in collar 100, this in turn will laterally displace the pin 108, resulting in axial displacement of the eccentric sleeve 48a due to the mechanical interconnection between the spade-like projection 110 and the walls of the groove 112. A thrust bearing 111 captured between the sleeve 48a and a sleeve extension 113 ensures that the respective roll shaft and roll duplicate the axial displacement of the sleeve.

In light of the foregoing, the advantages afforded by the present invention will now be readily appreciated by those skilled in the art. To begin with, the overall width "w" of the roll stand housing is dictated primarily by strength considerations and need only be slightly greater than the external diameter of the eccentric sleeves 48a,48b. The yoke assemblies 56a,56b which interconnect the eccentric sleeves of each set, and the roll parting and axial adjustment mechanisms contained in the module 66 are all confined within the width w. Thus, as illustrated in FIG. 4, not only can the spacing "x" between the work rolls of stands $S_1$ and $S_2$ be minimized, but the spacing "y" between the work rolls of stands $S_2$ and $S_3$ also can be similarly minimized. For example, for work roll diameters of 240 mm and sleeves 48a,48b having eccentricities on the order of 10 mm, the spacing "x" between the axes of roll pairs 34,34 and 36,36 can be minimized to about 240 mm, and the spacing "y" between roll pairs 36,36 and 38,38 can be kept to about 260 mm, or in general only about 8% greater than "x".

Because the roll parting and axial adjustment mechanisms are contained in separable modules 66, each module can be coupled alternatively to more than one roll stand. The roll stands thus can be more simple in design (not requiring dedicated integral adjustment mechanisms), with concomitant savings in capital investment for the mill operator.

It will be understood that the present invention is not limited to the precise components or combinations thereof herein chosen for purposes of disclosure, and that various changes may be made without departing from the spirit and scope of the invention as defined by the claims appended hereto.

For example, under certain circumstances it may be advantageous to only provide roll parting adjustments to one of the roll shafts of a given pair. Also, the eccentric sleeves of a given set may be rotatably coupled by means other than direct mechanical interconnection, including the provision of jointly driven electric or hydraulic motors and the like. The same may be true of the drive mechanism used to rotatably adjust one or both of the first eccentric sleeves of each set.

We claim:

1. A roll stand for a rolling mill, said roll stand comprising:

a housing having a through opening;

two sets of axially aligned first and second sleeves journalled in said housing for rotation about parallel axes, the first and second sleeves of each of said sets having axially aligned eccentric bores and being located on opposite sides of said opening;

a pair of roll shafts extending across said opening, segments of each of said roll shafts on opposite sides of said opening being journalled for rotation in the eccentric bores of the first and second sleeves of a respective one of said sets;

work rolls carried on said roll shafts, said work rolls being located in said opening and defining a roll pass therebetween;

coupling means for rotatably interconnecting the first and second sleeves of each of said sets;

a module detachably secured to and separable from said housing; and adjustment means contained within said module, said adjustment means being axially engageable with the first sleeves of each of said sets for simultaneously rotating said first sleeves in opposite directions, the rotation of said first sleeves being transmitted via said coupling means to the respective second sleeves of each of said sets to thereby adjust parting between the work rolls carried on said roll shafts, said adjustment means being separable from said first sleeves in conjunction with separation of said module from said housing.

2. The roll stand of claim 1 wherein said adjustment means comprises a pair of gears aligned with and rotatable about said parallel axes, interengagement means for rotatably connecting each of said gears to one of said first sleeves, and operating means for simultaneously rotating said gears in opposite directions.

3. The roll stand of claim 2 wherein said interengagement means comprises driving lugs fixed relative to said gears and driven lugs fixed relative to said first sleeves, and driving rings interposed between said gears and said first sleeves, said driving rings having notches arranged to receive and mechanically interengage with said driving and driven lugs.

4. The roll stand of claim 3 wherein said driving rings are shiftable radially with respect to the rotational axes of said gears.

5. The roll stand of claim 4 wherein said driving rings are axially engageable with and separable from said driven lugs, and are axially connected to said gears.

6. The roll stand of claim 1 wherein said coupling means comprises yoke assemblies interposed between confronting ends of said first and second sleeves, said yoke assemblies having collars surrounding said roll shafts on opposite sides of said work rolls, said collars being connected to inner ends of respective sleeves and having integral bridging segments with juxtaposed ends located laterally of said work rolls, and means for interconnecting said juxtaposed ends.

7. The roll stand of claim 1 further comprising means for axially adjusting one of said roll shafts in relation to the other of said roll shafts.

8. A roll stand for a rolling mill, said roll stand comprising:

a housing having a through opening;

a pair of work rolls supported by roll shafts, said work rolls being located in said through opening and defining a roll pass therebetween;

at least one set of aligned first and second sleeves journalled for rotation in said housing on opposite sides of said through opening, said sleeves having axially aligned eccentric bores, one of said roll shafts being journalled for rotation in said eccentric bores;

a module detachably secured to and separable from said housing;

adjustment means contained within said module and being axially engageable with one of said sleeves for rotating said one sleeve, said adjustment means being separable from said one sleeve in conjunction with separation of said module from said housing; and means responsive to the rotation of said one sleeve for imparting simultaneous rotation in the same direction to the other of said sleeves.

9. A roll stand for a rolling mill, said roll stand comprising:

a housing having a through opening;

two sets of axially aligned first and second sleeves journalled in said housing for rotation about parallel axes, the first and second sleeves of each of said sets having axially aligned eccentric bores and being located on opposite sides of said opening;

a pair of roll shafts extending across said opening, segments of each of said roll shafts on opposite sides of said opening being journalled for rotation in the eccentric bores of the first and second sleeves of a respective one of said sets;

work rolls carried on said roll shafts, said work rolls being located in said opening and defining a roll pass therebetween;

coupling means for rotatably interconnecting the first and second sleeves of each of said sets; and adjustment means engageable with the first sleeves of each of said sets for simultaneously rotating said first sleeves in opposite directions, the rotation of said first sleeves being transmitted via said coupling means to the respective second sleeves of each of said sets to thereby adjust the parting between the work rolls carried on said roll shafts, wherein said adjustment means comprises a pair of gears aligned with and rotatable about said parallel axes, interengagement means for rotatably connecting each of said gears to one of said first sleeves, and operating means for simultaneously rotating said gears in opposite directions, said interengagement means comprising driving lugs fixed relative to said gears and driven lugs fixed relative to said first sleeves, and driving rings interposed between said gears and said first sleeves, said driving rings having notches arranged to receive and mechanically interengage with said driving and driven lugs.

10. The roll stand of claim 9 wherein said driving rings are shiftable radially with respect to the rotational axes of said gears.

11. The roll stand of claim 10 wherein said driving rings are axially engageable with and separable from said driven lugs, and are axially connected to said gears.

12. The roll stand of claim 9, wherein said coupling means comprises yoke assemblies interposed between confronting ends of said first and second sleeves, said yoke assemblies having collars surrounding said roll shafts on opposite sides of said work rolls, said collars being connected to the inner ends of respective sleeves and having integral bridging segments with juxtaposed ends located laterally of said work rolls, and means for interconnecting said juxtaposed ends.

13. The roll stand of claim 9 further comprising means for axially adjusting one of said roll shafts in relation to the other of said roll shafts.

* * * * *